US005498358A

United States Patent [19]

Kim et al.

[11] Patent Number: 5,498,358

[45] Date of Patent: Mar. 12, 1996

[54] LUBRICANT CONTAINING OLIGOMER WITH FLEXIBLE AND MESOGENIC SEGMENTS

[75] Inventors: Ki-Soo Kim, Katonah, N.Y.; Sophia Dashevsky, Fair Lawn, N.J.; Johst H. Burk, Mohegan Lake, N.Y.

[73] Assignee: Akzo Nobel N.V., Arnhem, Netherlands

[21] Appl. No.: 235,779

[22] Filed: Apr. 29, 1994

[51] Int. Cl.[6] ..... C10M 129/16

[52] U.S. Cl. ..... 252/51.005 A; 252/52 A

[58] Field of Search ..... 252/51.5 A, 52 A

[56] References Cited

U.S. PATENT DOCUMENTS

| | | | |
|---|---|---|---|
| 4,781,849 | 11/1988 | Biresaw et al. | 252/49.5 |
| 4,952,334 | 8/1990 | Hakemi et al. | 252/299.01 |
| 4,992,189 | 2/1991 | Chen et al. | 252/52 A |
| 4,999,122 | 3/1991 | Lockwood et al. | 252/32.5 |
| 5,026,496 | 6/1991 | Lakyawa et al. | 252/52 A |
| 5,068,048 | 11/1991 | Chen et al. | 252/52 A |

FOREIGN PATENT DOCUMENTS

| | | | |
|---|---|---|---|
| 92682 | 11/1983 | European Pat. Off. | C10M 1/00 |
| 478034 | 4/1992 | European Pat. Off. | C10M 171/00 |
| 567649 | 11/1993 | European Pat. Off. | C10M 171/00 |

OTHER PUBLICATIONS

Tribology and the Liquid-Crystalline State, ACS Symposium Series 441 pp. 101–111 (1990) month unavailable.

Tribology Transactions vol. 31, 4, 442–448 (1987) month unavailable.

Tribology International, Feb. 1991, vol. 24, No. 1, pp. 25–28.

Lubrication Science 4–3, Apr. 1992 (4) 191–199 month unavailable.

Chemical Abstracts, vol. 99, 107765z (1983) month unavailable.

Chemical Abstracts, vol. 102, 187599s (1985) month unavailable.

Chemical Abstracts, vol. 100, 36902t (1984) month unavailable.

*Primary Examiner*—Jacqueline V. Howard

*Attorney, Agent, or Firm*—Richard P. Fennelly; Louis A. Morris

[57] ABSTRACT

A lubricant composition for an internal combustion engine contains a lubricant basestock and an effective amount for antiwear properties of an oligomer containing at least one mesogenic segment and at least one flexible segment. The oligomer can have a centrally disposed flexible segment, e.g., derived from a polyalkylene glycol such as polypropylene glycol, with mesogenic segments as end caps or it can contain alternating flexible and mesogenic segments, e.g., comprising a repeat unit comprising aromatic ester groups and at least one linear polyalkylene spacer. The oligomer preferably has a molecular weight of from about 1,000 to about 4,000 and is present at from about 0.1% to about 3%, by weight of the basestock.

18 Claims, 3 Drawing Sheets

EFFECT OF THE LCO ON THE COF OF THE MINERAL OIL AT 65°C/5KG/1200RPM. 1-CONTROL,2-2% LCO.

EFFECT OF THE LCO ON THE COF OF THE MINERAL OIL AT 65°C/5KG/1200RPM. 1-CONTROL,2-2% LCO.

1-CONTROL; 2-1% LCO; 3-2% LCO

1-CONTROL; 2-1% LCO; 3-2% LCO

LUBRICANT CONTAINING OLIGOMER WITH FLEXIBLE AND MESOGENIC SEGMENTS

BACKGROUND OF THE INVENTION

The field of lubricating internal combustion engines is constantly striving to develop novel lubricant compositions for increasing the lubricity of lubricant oils, reducing the wear rate of the metals being lubricated, and increasing the load bearing properties between the various surfaces within the engine.

Liquid crystalline compositions, by and large, have not attracted much attention within the field of lubrication as have more conventional chemical additives. Among the disclosures known to the present inventors are the following:

U.S. Pat. No. 4,781,849 to G. Biresaw et al. describes a metalworking lubricant which comprises a lyotropic liquid crystal and contained certain defined amounts of natural or synthetic oil, water-soluble surfactant, organic cosurfactant comprising a $C_4$–$C_{12}$ 1,2-alkanediol, and water containing less than about 1 wt % dissolved inorganic salts.

European Patent Publication No. 92,682 describes the use of certain liquid crystalline compounds, such as cyanobiphenyl, in a watch lubricant rather than in a lubricant for an internal combustion engine.

The addition of such liquid crystalline compounds as cholesterol caproate (Chemical Abstracts, 1983, Vol.99, 107765z) and certain benzoic acid derivatives (Chemical Abstracts, 1985, Vol. 102, 187599s) to lubricating oils was studied by A. P. Gribailo and coworkers and reported by B. I Kupchinov et al. in Tribology International, February 1991, Vol. 24, No.1, pp. 25–28 along with their work on using industrially produced thermotropic liquid crystals.

DESCRIPTION OF THE DRAWINGS

The Drawings, which are attached hereto as a part of the present Specification, illustrate.

DESCRIPTION OF THE INVENTION

Figure 1:
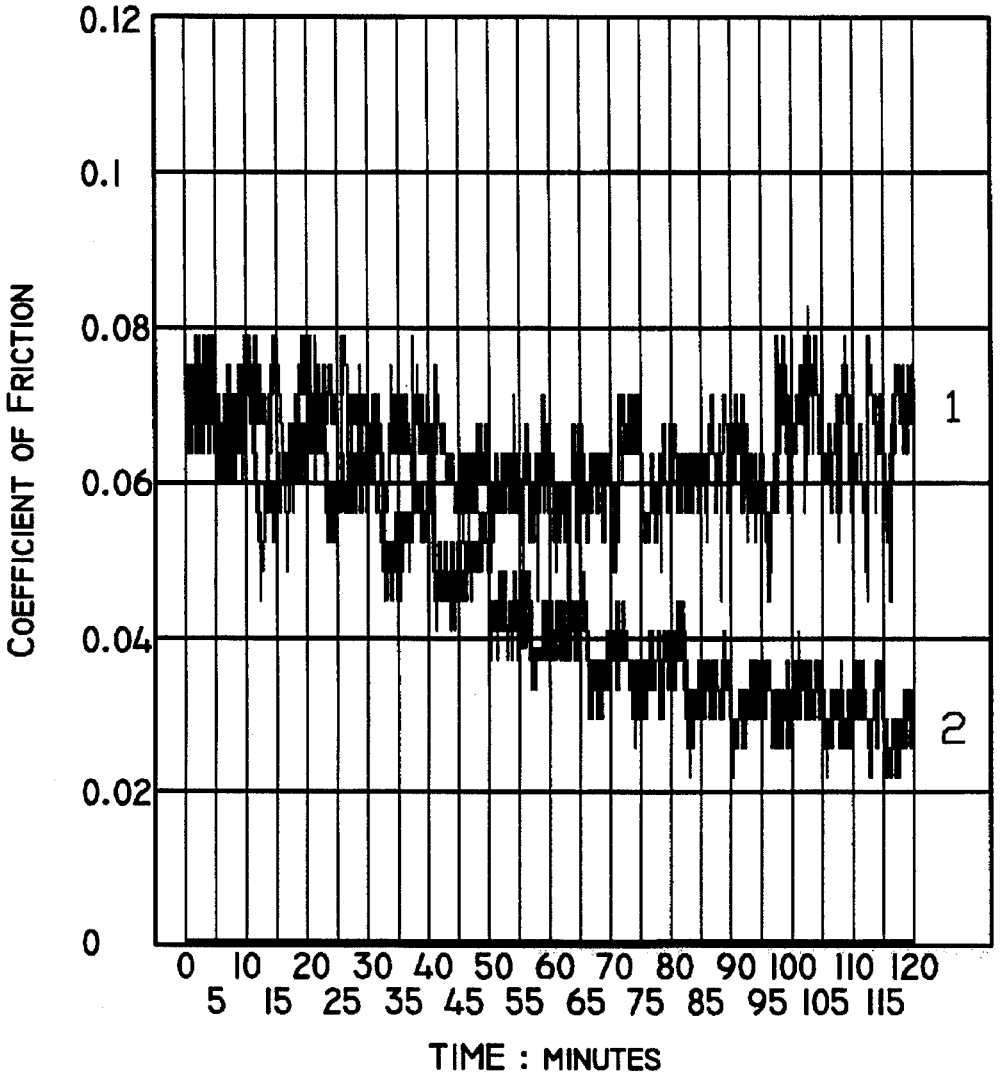
in FIG. 1 the improvement in performance of a lubricant containing the liquid crystalline additive of Example 3 over a control lubricant not containing the additive; and in FIGS. 2 and 3, the improvement in performance of a lubricant containing the liquid crystalline additive of Example 4 at two different concentrations over a control lubricant not containing the additive.

A lubricant composition for an internal combustion engine contains a lubricant basestock and an effective amount for antiwear properties of an oligomer containing at least one mesogenic segment and at least one flexible segment. The oligomer can have a centrally disposed flexible segment, e.g., derived from a polyalkylene glycol such as polypropylene glycol, with mesogenic segments as end caps or it can contain alternating flexible and mesogenic segments, e.g., comprising a repeat unit comprising aromatic ester groups and at least one linear polyalkylene spacer. The oligomer preferably has a molecular weight of from about 1,000 to about 4,000 and is present at from about 0.1% to about 3%, by weight of the basestock.

The present invention is deemed to be broadly applicable for use in lubricant compositions containing either natural or synthetic basestocks and functional lubricant additives such as antioxidants, viscosity improvers, dispersants, antiwear agents, and the like.

One type of liquid crystalline oligomer, which has utility as a lubricant additive in accordance with the present invention, contains a flexible polyalkylene glycol-derived segment, such as, a segment derived from polypropylene glycol, can have a molecular weight of from about 1,000 to about 4,000, and is end capped on the glycol-derived segment by a mesogenic segment, for example, one derived from a p-(p-alkoxybenzoyloxy) benzoylchloride, such as, from p-(p-butoxybenzoyloxy) benzoyl chloride. Such an oligomer can be represented by the following formula:

$$[R[OArC]_2-\overset{\overset{\displaystyle O}{\|}}{N}-\overset{\overset{\displaystyle H}{|}}{\underset{\underset{\displaystyle CH_3}{|}}{CHCH_2}}]_n-PAG$$

where Ar is para-phenylene, PAG represents a moiety derived from a polyalkylene glycol, such as polypropylene glycol, and R is alkyl, such as alkyl of from about one to about four carbon atoms, and n can be 2 or 3.

The type of oligomer described in the preceding paragraph can be prepared by N-acylating an amine-terminated polyalkylene oligomer products (such as those commercially available amine-terminated polypropylene glycol oligomers commercially available under the trademark JEFFAMINE, from Texaco Chemical) with a compound, such as a p-(p-alkoxybenzoyloxy) benzoylchloride. The resulting capped oligomers have been found to be soft waxy solids which are soluble in such organic solvents as toluene, methylene chloride, and chloroform They are liquids above about 80° C. and polarizing optical microscopy shows liquid crystal behavior with a clearing temperature near 140° C.

Another type of oligomer which can be used are the type of liquid crystal oligomers described and claimed in U.S. Ser. No. 156,668, filed Nov. 23, 1993, which is incorporated herein by reference. Included are those of the general structure:

$$[-A-Y-X-Z-]_m \qquad (I)$$

as set forth in U.S. Pat. No. 4,952,334, for example, which is incorporated herein by reference. In the above formula, X (the "polyalkylene" spacer) can be $(CH_2)_n$ and $(CH_2CH_2O)_n$, where n is an integer of from 2 to 10, m can range from about 2 to about 10, and Y and Z can preferably each be —C(O)O— or — C(O)NH— or can be a single bond between two carbon atoms, and A can be p-phenylene, 1,4-, 2,6-, or 1,5-naphthylene, monosubstituted phenylene with methyl, chloro, or phenyl substitution; —ArCH=CHAr—, where Ar is a phenyl ring, —Ar—C(O)OAr—, —Ar—C(O)NHAr—, or —ArOC(O)—Ar—C(O)O—Ar—, as more fully depicted in the aforementioned patent. In addition, another mesogenic unit which can be employed has the structure —Ar—C(O)—NH—Ar—NH—C(O)—Ar—. Yet another mesogenic unit can have the formula —ArC(O)OAr'OC(O)Ar— where Ar' can be unsubstituted or substituted (e.g., alkyl or alkoxy) phenyl (derived from hydroquinone) or biphenyl (derived from biphenol) and Ar can be derived from terephthalic or the mesogenic-producing naphthylenic starting materials. The commercial rod polymers based on oxybenzoate units, 4,4'-biphenylene terephthalate units, and oxynaphthalene carboxylate units (the latter two including copolymers with the oxybenzoate units) can be especially preferred.

A particularly preferred oligomer has the repeat unit $$-[(CH_2)_nOC(O)ArOC(O)ArC(O)OArC(O)O]-$$

where n can range from 4 to 10, preferably 6 to 9, and Ar are each para-phenylene.

The present invention is further illustrated by the Examples which follow.

EXAMPLE 1

This Example illustrates synthesis of flexible polypropylene glycol oligomer capped with a mesogenic esteramide block and having the following formula (PPG= polypropylene glycol and n=2):

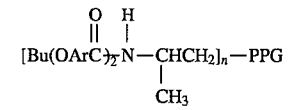

where Ar is para-phenylene.

In a dry, argon-flushed, 250 mL round-bottom flask equipped with a rubber septum cap and magnetic stirring, 1.00 g or 3.0 mmol, of p-(p-butoxybenzoyloxy)benzoyl chloride was dissolved in 50 mL of freshly distilled 1,4-dioxane. After the acid chloride dissolved, 1 mL of pyridine and 0.10 g of 4-dimethylaminopyridine were added, causing a white precipitate to form. The mixture was heated with stirring in an oil bath to 60° C. under argon atmosphere.

Simultaneously, in a 100 mL round-bottom flask equipped with a rubber septum cap and magnetic stirring, 2.0 g or 1.00 mmol of dry amine-terminated, linear PPG 2000 (JEFFAMINE brand difunctional $M_n$=2000, JD2000) was dissolved in 50 mL of freshly distilled 1,4-dioxane, 1 mL pyridine and 0.10 g of 4-dimethylaminopyridine. This solution was stirred until homogeneous, then added through a cannula in 10 mL aliquots to the stirring heated acid chloride solution. The reaction progress was monitored after each addition by infrared analysis. Reaction was assumed to be complete when the IR spectrum showed an absorption band at 1760 $cm^{-1}$ (which is due to the excess acid chloride), and the new absorption band at 1665 $cm^{-1}$, which is due to the amide carbonyl, reaches a maximum. The reaction was continued for an additional thirty-six hours after IR indicated completion.

After completion of the reaction, 10 mL of wet pyridine (5% $H_2O$) was added to the reaction mixture to hydrolyze excess acid chloride as the reaction mixture was stirred at 60° C. for twenty-four hours. The reaction mixture was then poured into 300 mL of distilled water, and the resulting precipitate was extracted into diethyl ether (3×200 mL). The combined organic extracts were washed with 10% aqueous hydrochloric acid (3×80 mL), water (2×100 mL), saturated sodium carbonate solution (3×80 mL), and water (4×100 mL), respectively. The ether layer was dried over ($MgSO_4$) and filtered to remove the drying agent. The solvent is then removed, yielding a pale yellow waxy solid oligomer. TLC of the product revealed a single component distinct from that of the starting materials. Yield 2.3 g (89%). IR (neat): 3350 (m, amide N—H), 3020 (w, Ar—H), 2990-2700 (vs, aliphatic C—H), 1735 (vs, ester C=O), 1660, 1640 (s, non hydrogen bonded and hydrogen bonded amide C=O), 1605 (s, aromatic C=C). $^1H$ NMR ($CDCl_3$, 300 MHz), δ (ppm): 0.9 (t, 6 H $CH_3$ from the butyl chain), 1.1 (d, 102 H, pendant $CH_3$ internal and terminal α to amide), 1.45, 1.75 (two m, 8 H, ε and β—$CH_2$), 3.2–3.7 (m, 100 H, —$CH_2CH$—), 4.0 (m, 2 H, CH α to amide nitrogen), 6.9 (d, 4 H, o to Ar—O—R), 7.20 (d, 4 H, o to Ar— OCO—), 7.8 (m. 2 H, amide N—H), 8.00–8.20 (m, 8 H, Ar o to ester carbonyl and amide carbonyl).

EXAMPLE 2

This shows synthesis of a mesogen-capped oligomer similar to the oligomer of Example 1 where n=3.

The same procedure was used with the following reagents: JT3000, 2.0 g, 0.66 mmol. p—BuBBCl, 1.00 g, 3.0 mmol.

The oligomer was a pale yellow waxy solid. Yield 2.35 g (90%). IR (neat): 3350 (m, amide N—H), 3020 (w, Ar—H), 2990- 2700 (vs, aliphatic C—H), 1735 (vs, ester C=O), 1660, 1640 (s, non hydrogen bonded and hydrogen bonded amide C=O), 1605 (s, aromatic C=C). $^1H$ NMR ($CDCl_3$, 300 MHz) α (ppm): 0.9 (t, 9 H, $CH_3$ from the butyl chain), 1.1 (d, 153 H, pendant $CH_3$ internal and terminal α to amide), 1.45, 1.75 (two m, 12 H, ε and β—$CH_2$), 3.2–3.7 (m, 150 H, —$CH_2CH$—), 4.0 (m, 3 H, CH α to amide carbonyl), 6.9 (d, 6 H, o to Ar—O—R), 7.20 (d, 6 H, o to Ar—OCO—), 7.8 (m, 3 H, amide N—H), 8.00–8.20 (m, 12 H, Ar o to ester carbonyl and amide carbonyl).

EXAMPLE 3

The oligomer synthesized in Example 2 was added to a mineral oil basestock (FLEXON 845 brand from Exxon) at a 2 wt % concentration. The mixture was heated with stirring up to 120° C. until a homogeneous and clear blend solution was obtained. On cooling, the blend became homogeneously hazy. Transitions from hazy to clear and from clear to hazy were observed at about 60° C. when the blend was repeatedly subjected to a heating-cooling cycle. No precipitation was observed during the storage of the blend at room temperature. The blend was tested in accordance with ASTM D-4172 (modified), 4-Ball Wear/Coefficient of Friction test, at 65° C. At this temperature the liquid crystalline oligomer was in the nematic state and the blend was clear.

As shown in FIG. 1, the lubricant composition containing the oligomer additive had a significantly smaller wear scar (0.27 mm versus 0.44 mm) and a lower average coefficient of friction (0.046 versus 0.065) as compared to the control not containing the oligomer additive. Table 1 summarizes the test results:

| Test Conditions Load/Temp/Speed/Time | Scar Size, mm | Coeff. of Friction Grand average |
|---|---|---|
| 5 kg/65° C./1200 rpm/1 hr | | |
| A (control) | 0.35 | 0.058 |
| A + 2% LC (PPG3000) | 0.26 | 0.054 |
| 5 kg/65° C./1200 rpm/2 hrs | | |
| A (control) | 0.41 | 0.065 |
| A + 2% LC (PPG3000) | 0.27 | 0.046 |
| 15 kg/65° C./600 rpm/2 hrs | | |
| A (control) | 0.70 | 0.079 |
| A + 2% LC (PPG3000) | 0.38 | 0.089 |
| A + 2% LC (PPG2000) | 0.58 | 0.090 |

EXAMPLE 4

A liquid crystalline oligomer of the type described in copending U.S. Ser. No. 156,668, filed Nov. 23, 1993, with a degree of polymerization of 3, a flexible spacer comprising $(CH_2)_7$, having nematic liquid crystal behavior from 170° C. to 240° C. was dissolved in a polyol ester basestock (HATCOL 2939 brand, which is the trimethylolpropane ester of pelargonic acid, from Hatco Corp.) at 1 wt % and 2 wt % concentrations. The mixtures were heated with stirring up to 230° C. until homogeneous and clear blend solutions were obtained. On cooling, the blends became hazy. Transitions from hazy to clear and from clear to hazy were observed at about 165° C. when the blends were repeatedly subjected to a heating-cooling cycle. The lubricant samples containing the oligomer were tested, as described in Example 3, within the nematic temperature range, against a control lubricant not containing the oligomer.

Figure 2:
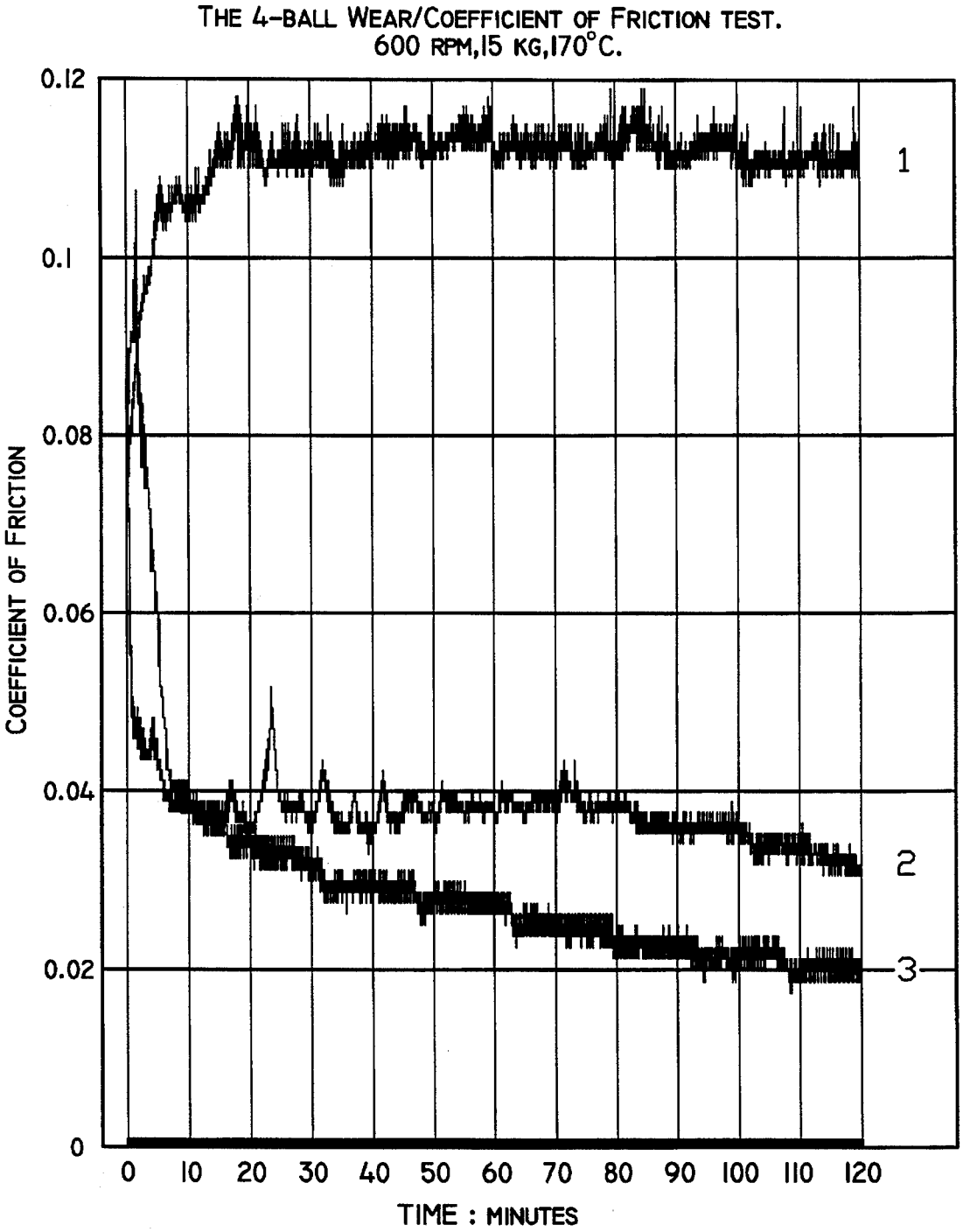
Figure 3:
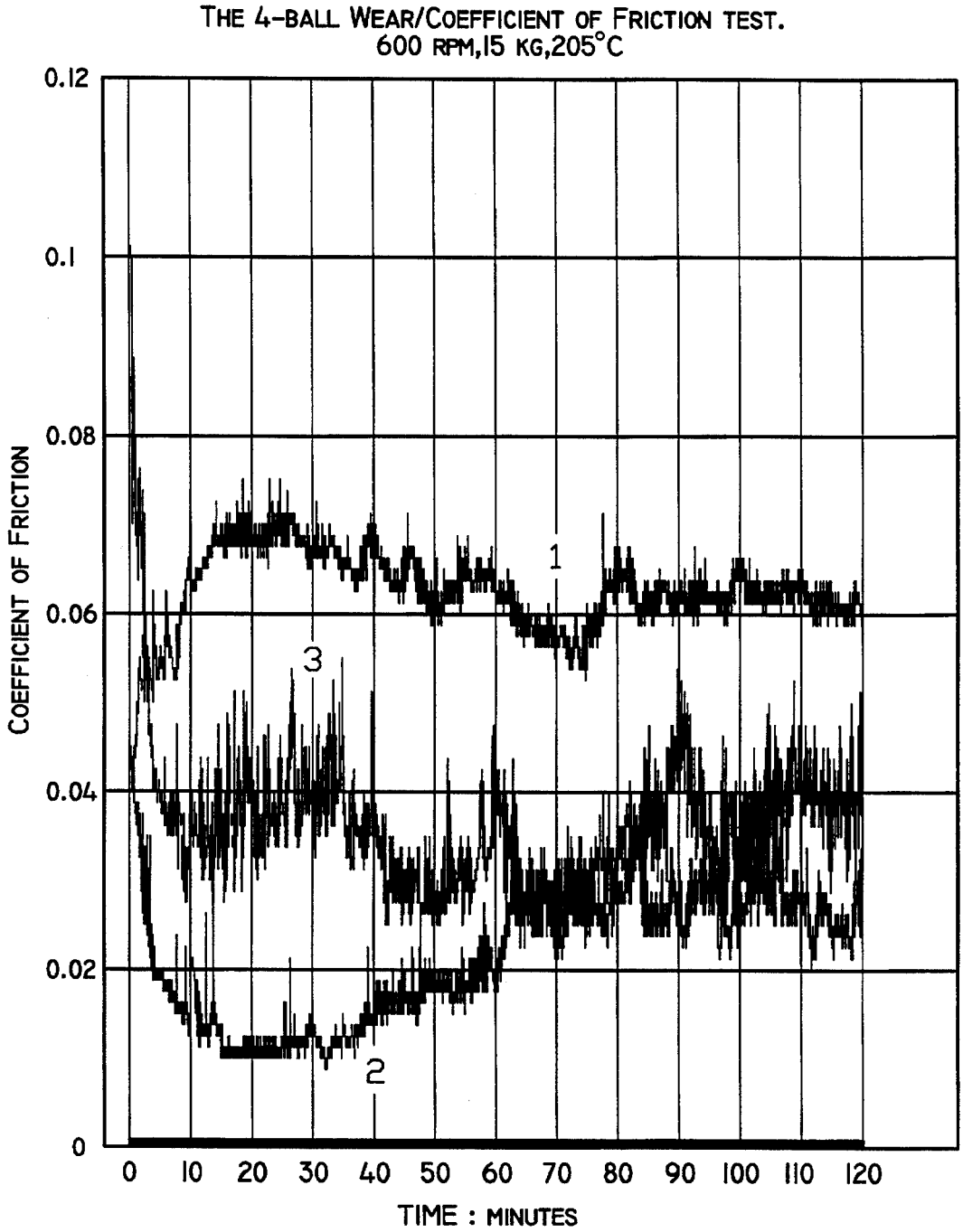

The addition of the oligomer (abbreviated "LCO") reduced the coefficient of friction of the polyol ester at temperatures of 170° C. (FIG. 2) and 205° C. (FIG. 3) under a loading of 15 kg in the test. The coefficient of friction of the composition containing the oligomer at the 2 wt % level was also found to be lower by about four fold, as compared to the control, at 170° C. The improvement in wear scar was not as significant. Table 2 summarizes the test results:

| Test Conditions Load/Temp/Speed/Time | Scar Size, mm | Coeff. of Friction Grand Average |
|---|---|---|
| 15 kg/170° C./600 rpm/2 hrs | | |
| B (control) | 0.48 | 0.113 |
| B + 1% LC (TR-7) | 0.54 | 0.037 |
| B + 2% LC (TR-7) | 0.50 | 0.030 |
| 15 kg/205° C./600 rpm/2 hrs | | |
| B (control) | 0.74 | 0.063 |
| B + 1% LC (TR-7) | 0.65 | 0.025 |
| B + 2% LC (TR-7) | 0.68 | 0.032 |

We claim:

1. A lubricant composition for an internal combustion engine which comprises a lubricant basestock and an effective amount for antiwear properties of an oligomer containing at least one mesogenic segment and at least one flexible segment.

2. A composition as claimed in claim 1 wherein the flexible segment comprises at least one alkylene moiety.

3. A composition as claimed in claim 2 wherein the alkylene moiety contains no less than about three carbon atoms.

4. A composition as claimed in claim 1 wherein the oligomer comprises a centrally disposed flexible segment with mesogenic segments as end caps.

5. A composition as claimed in claim 1 wherein the oligomer comprises alternating flexible and mesogenic segments.

6. A composition as claimed in claim 4 wherein the centrally disposed flexible segment is derived from a polyalkylene glycol.

7. A composition as claimed in claim 5 wherein the oligomer comprises a repeat unit comprising aromatic ester groups and at least one linear polyalkylene spacer.

8. A composition as claimed in claim 6 wherein the polyalkylene glycol is polypropylene glycol.

9. A composition as claimed in claim 1 wherein the oligomer has a molecular weight of from about 1,000 to about 4,000.

10. A composition as claimed in claim 1 wherein the oligomer is present at from about 0.1% to about 3%, by weight of the basestock.

11. A composition as claimed in claim 1 wherein the oligomer comprises a centrally disposed flexible segment with mesogenic segments as end caps, has a molecular weight of from about 1,000 to about 4,000, and is present at from about 0.1% to about 3%, by weight of the basestock.

12. A composition as claimed in claim 1 wherein the oligomer comprises alternating flexible and mesogenic segments, has a molecular weight of from about 1,000 to about 4,000, and is present at from about 0.1% to about 3%, by weight of the basestock.

13. A composition as claimed in claim 11 wherein the centrally disposed flexible segment is derived from a polyalkylene glycol.

14. A composition as claimed in claim 12 wherein the oligomer comprises a repeat unit comprising aromatic ester groups and at least one linear polyalkylene spacer.

15. A composition as claimed in claim 13 wherein the polyalkylene glycol is polypropylene glycol.

16. A composition as claimed in claim 4 wherein the oligomer is of the formula:

$$[R[OArC]_2-\overset{\overset{\displaystyle O}{\|}}{}\overset{\overset{\displaystyle H}{|}}{N}-\underset{\underset{\displaystyle CH_3}{|}}{CHCH_2}]_n-PAG$$

where Ar is para-phenylene, PAG represents a moiety derived from a polyalkylene glycol, R is alkyl, and n is 2 or 3.

17. A composition as claimed in claim 16 wherein the polyalkylene glycol is polypropylene glycol.

18. A composition as claimed in claim 16 wherein the polyalkylene glycol is polypropylene glycol and R is alkyl of from about one to about four carbon atoms.

* * * * *